US011009267B2

(12) United States Patent
Rajan et al.

(10) Patent No.: US 11,009,267 B2
(45) Date of Patent: May 18, 2021

(54) HVAC SYSTEM AND METHOD OF IMPROVING LATENT CAPACITY

(71) Applicant: Lennox Industries Inc., Richardson, TX (US)

(72) Inventors: Siddarth Rajan, Chennai (IN); Rakesh Goel, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 345 days.

(21) Appl. No.: 16/140,075

(22) Filed: Sep. 24, 2018

(65) Prior Publication Data

US 2020/0096236 A1 Mar. 26, 2020

(51) Int. Cl.

| | |
|---|---|
| ***F25B 5/02*** | (2006.01) |
| ***F25B 41/20*** | (2021.01) |
| ***F24F 11/30*** | (2018.01) |
| ***F25B 39/02*** | (2006.01) |
| ***F24F 11/84*** | (2018.01) |
| ***F24F 11/70*** | (2018.01) |
| *F24F 110/30* | (2018.01) |
| *F24F 11/46* | (2018.01) |

(52) U.S. Cl.

CPC ..... *F25B 5/02* (2013.01); *F24F 11/30* (2018.01); *F24F 11/70* (2018.01); *F24F 11/84* (2018.01); *F25B 39/028* (2013.01); *F25B 41/20* (2021.01); *F24F 11/46* (2018.01); *F24F 2110/30* (2018.01); *F25B 2339/02* (2013.01); *F25B 2600/2511* (2013.01)

(58) Field of Classification Search

CPC .. F25B 5/02; F25B 41/04; F25B 39/08; F25B 2600/2511; F25B 2700/173; F25B 41/20; F24F 11/83; F24F 11/84; F24F 2110/30

USPC ..... 62/199, 200, 504

See application file for complete search history.

(56) References Cited

U.S. PATENT DOCUMENTS 3,977,205 A * 8/1976 Dreisziger ..... F25B 5/02 62/117
9,121,641 B2 * 9/2015 Wu ..... F25B 5/00
(Continued)

FOREIGN PATENT DOCUMENTS

JP 2004352258 A 12/2004
WO 2018062316 A1 4/2018

OTHER PUBLICATIONS

European Patent Office, Extended European Search Report, Application No. 19194175.6, dated Feb. 24, 2020, 7 pages.
U.S. Appl. No. 15/948,049, filed Apr. 9, 2018, Goel et al.

*Primary Examiner* — Edward F Landrum
*Assistant Examiner* — Daniel C Comings
(74) *Attorney, Agent, or Firm* — Baker Botts L.L.P.

(57) ABSTRACT

A method of operating an HVAC system comprising a first and second portion of evaporator circuits, the first portion being adapted to receive refrigerant from a first refrigerant path and the second portion being adapted to receive the refrigerant from a second refrigerant path. The method comprises determining a first value that is calculated based on a speed of an air blower and a total capacity of the HVAC system, and the air blower is operable to push a minimum volume of air in to the enclosed space. The method further comprises upon determining that the first value exceeds a cooling threshold or that the first value exceeds a dehumidification threshold, instructing a valve to close such that refrigerant cannot flow to the first portion of evaporator circuits.

20 Claims, 4 Drawing Sheets

(56) References Cited

U.S. PATENT DOCUMENTS

| | | | | |
|---|---|---|---|---|
| 2006/0288713 | A1* | 12/2006 | Knight | F25B 49/027 62/176.6 |
| 2016/0178222 | A1 | 6/2016 | Bush et al. | |
| 2017/0356671 | A1 | 12/2017 | Goel | |

* cited by examiner

HVAC SYSTEM AND METHOD OF IMPROVING LATENT CAPACITY

TECHNICAL FIELD

This disclosure relates generally to operating a heating, ventilation, and air conditioning ("HVAC") system. More specifically, this disclosure relates to a system and method of improving the latent capacity of an HVAC system.

BACKGROUND

Heating, ventilation, and air conditioning ("HVAC") systems can be used to regulate the environment within an enclosed space. Typically, an air blower is used to pull air from the enclosed space into the HVAC system through ducts and push the air back into the enclosed space through additional ducts after conditioning the air (e.g., heating, cooling or dehumidifying the air). Various types of HVAC systems, such as residential and commercial, may be used to provide conditioned air for enclosed spaces.

Each HVAC system typically includes a HVAC controller that directs the operation of the HVAC system. The HVAC controller can direct the operation of a conditioning unit, such as an air conditioner or a heater, to control the temperature and humidity within an enclosed space.

SUMMARY OF THE DISCLOSURE

According to one embodiment, a heating, ventilation, and air conditioning ("HVAC") system is operable to condition an enclosed space, the HVAC system comprises an evaporator, a valve, an air blower, and a controller. The evaporator is operable to cool and/or dehumidify air circulating through the HVAC system, the evaporator comprising one or more evaporator circuits, the one or more evaporator circuits comprising: a first portion adapted to receive the refrigerant from a first refrigerant path and a second portion adapted to receive the refrigerant from a second refrigerant path. The valve is operable to permit or restrict the flow of the refrigerant to the second portion of the one or more evaporator circuits. The air blower is operable to push at least a minimum volume of air into the enclosed space. The controller comprises processing circuitry and a computer readable storage medium comprising instructions that, when executed by the processing circuitry, cause the controller to: determine a first value associated with the HVAC system, wherein the first value is calculated based on a speed of the air blower and a total capacity of the HVAC system. The controller further comprises instructions that, when executed by the processing circuitry, cause the controller to close the valve such that the refrigerant cannot flow to the second portion of the evaporator circuits upon determining that: the first value exceeds a cooling threshold; or the first value exceeds a dehumidification threshold.

According to another embodiment, a method of operating a HVAC system comprising a first portion of evaporator circuits and a second portion of evaporator circuits, the first portion of evaporator circuits being adapted to receive refrigerant from a first refrigerant path and the second portion of evaporator circuits being adapted to receive the refrigerant from a second refrigerant path. The method comprises determining, by a controller of the HVAC system, a first value associated with the HVAC system, wherein: the first value is calculated based on a speed of an air blower of the HVAC system and a total capacity of the HVAC system and the air blower is operable to push a minimum volume of air in to the enclosed space. The method further comprises upon determining that the first value of the HVAC system exceeds a cooling threshold or that the first value of the HVAC system exceeds a dehumidification threshold, instructing, by the controller, a valve of the HVAC system to close such that refrigerant cannot flow to the first portion of evaporator circuits of the HVAC system.

According to yet another embodiment, a controller for am HVAC system includes processing circuitry and a computer readable storage medium comprising instructions that, when executed by the processing circuitry, cause the controller to: determine a first value associated with the HVAC system, wherein: the first value is calculated based on a speed of an air blower of the HVAC system and a total capacity of the HVAC system and the air blower is operable to push a minimum volume of air in to the enclosed space. The HVAC system further comprises instructions that, when executed by the processing circuitry, cause the controller to instruct a valve of the HVAC system to close such that refrigerant cannot flow to a first portion of evaporator circuits of the HVAC system upon determining that the first value exceeds a cooling threshold or that the first value exceeds a dehumidification threshold. The HVAC system further comprises a second portion of evaporator circuits and the first portion of evaporator circuits are adapted to receive the refrigerant from a first refrigerant path and the second portion of evaporator circuits are adapted to receive the refrigerant from a second refrigerant path.

Certain embodiments may provide one or more technical advantages. For example, an embodiment of the present disclosure may improve the HVAC system's ability to dehumidify an enclosed space when operating an air blower at a minimum speed. As another example, an embodiment of the present invention allows dehumidification with reduced and/or minimal overcooling relative to conventional HVAC systems. As yet another example, an embodiment of the present invention may provide various efficiency benefits over conventional HVAC systems due to operation of components at lower speeds and/or reduced cycling between operation. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
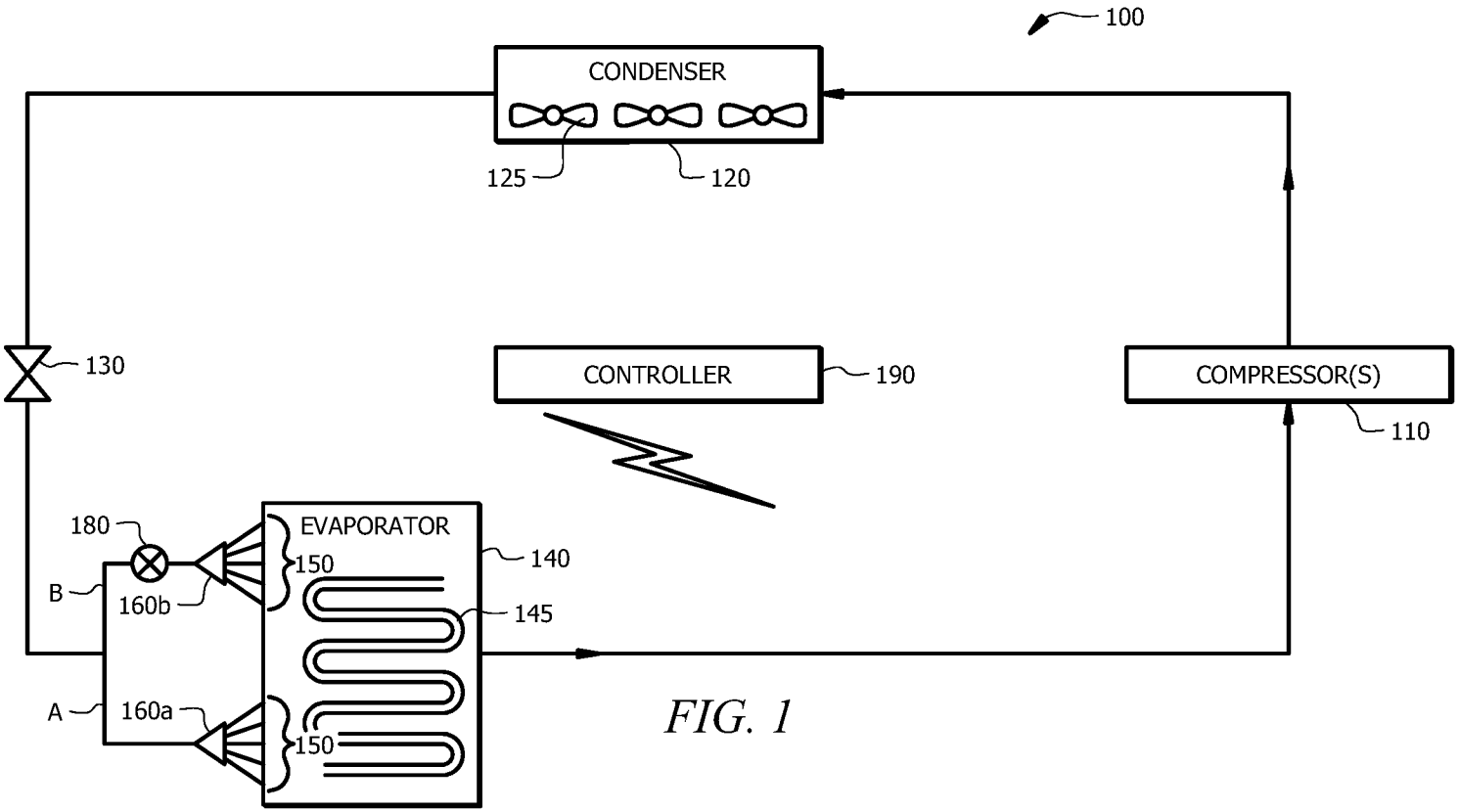
FIG. 1 illustrates an example of a heating, ventilation, and air condition ("HVAC") system operable to increase its capacity to remove latent heat from an enclosed space, according to certain embodiments.

Embodiments of the present disclosure and its advantages are best understood by referring to FIGS. 1 through 4 of the drawings, like numerals being used for like and corresponding parts of the various drawings.

Conventional HVAC systems are typically configured to supply an enclosed space with conditioned air that is comfortable for an operator. The air supplied by the HVAC system has an associated temperature and an associated relative humidity. In some HVAC systems, the temperature and/or the humidity of the supply air (e.g., using a thermostat) may be adjusted in order to meet an operator's desired comfort.

Conventional HVAC systems may operate in one or more modes. As an example, an HVAC system may operate in a cooling mode when the outside-air temperature is significantly warmer than an inside-air temperature setpoint. In such case, the HVAC system will continue to operate in an effort to effectively cool and dehumidify the conditioned air. As another example, an HVAC system may operate in a dehumidification mode when there is a low sensible cooling load but high relative humidity (e.g., when the outside air temperature is relatively close to the inside air temperature setpoint, but the outside air temperature is considerably more humid than the inside air).

Dehumidification using conventional HVAC systems, however, is far from optimal. This is because an HVAC system's ability to dehumidify an enclosed space is tied to operation of the HVAC system. Indeed, HVAC systems remove moisture from the air by circulating moisturized air over and/or through evaporator coils that are colder in temperature than the moisturized air (e.g., because of the temperature of refrigerant circulating through the evaporator coils). As a result of heat-exchange principles, the circulating air is cooled and the moisture from the moisturized air condenses on the evaporator coils, thereby producing dehumidified cold air which may then be directed to an enclosed space via a return air duct. Generally, an HVAC system ceases to operate once a temperature setpoint has been reached. For example, most HVAC systems will discontinue operation once an enclosed space has reached a programmed temperature setpoint (e.g., 73° F.). Although the temperature of the enclosed space may be desirable (e.g., 73° F.) when the HVAC system ceases operation, the relative humidity of the enclosed space may not be (e.g., 80% relative humidity). In such case, an occupant of the enclosed space may have to make a choice to sacrifice temperature for relative humidity. As a result, an occupant may reprogram the temperature setpoint to an undesirable temperature (e.g., 65° F.) in order to decrease the relative humidity of the enclosed space to a more desirable value (e.g., 44% relative humidity).

As explained above, dehumidification in conventional HVAC systems is possible only when the HVAC system is operational. Continuous operation or frequent cycling of the HVAC system, however, may have various disadvantages. For example, continuous operation of the HVAC system may result in overcooling (used herein to refer to the cooling of an enclosed space beyond that which is comfortable for an occupant). Overcooling, in turn, may result in discomfort for one or more occupants of the enclosed space. As another example, continuous operation of the HVAC system will result in increased utility charges. As yet another example, continuous operation of the HVAC system will likely result in the reduced life-span and/or increased risk of damage to one or more components of the HVAC system.

Each HVAC system has a total capacity (Tc), which is calculated as the sum of a sensible capacity (Sc) and a latent capacity (Lc). Generally, sensible capacity refers to an ability of the HVAC system to remove sensible heat from conditioned air. As used herein, sensible heat refers to heat that, when added to or removed from the air, results in a temperature change of the conditioned air. Comparatively, latent heat refers to the ability of an HVAC system to remove latent heat from conditioned air. As used herein, latent heat refers to heat that, when added to or removed from the conditioned air, results in a phase change of, for example, water within the conditioned air. Sensible capacity and latent capacity may vary with environmental conditions.

The total capacity of an HVAC system is calculated as the sum of the HVAC system's sensible capacity and latent capacity. In other words, $T_c=S_c+L_c$. A sensible-to-total ratio ("S/T ratio") may also be calculated using sensible and latent capacity values: S/T Ratio=Sc/Tc. The S/T ratio may represent the comfort of an occupant within a conditioned space. Generally, a lower S/T ratio is indicative of a greater capacity for dehumidification whereas a higher S/T ratio is indicative of a lesser capacity for dehumidification. Thus, if the sensible capacity value is very high, the HVAC system will have a high S/T ratio (e.g., 0.9). In the example of a 0.9 S/T ratio, the HVAC system is devoting 90% of its total capacity to removing sensible heat and 10% of its total capacity to remove latent heat. Such a scenario may lead to humidity problems.

It is difficult to achieve a desirable S/T ratio (based on the operating mode (i.e., cooling or dehumidification) when components of the HVAC system are operating at very low speeds. For example, a "good" S/T ratio is difficult to achieve when operating a compressor at low speeds because air blowers have a minimum airflow which prevents blowers from slowing down beyond a particular point. Even if blowers could be slowed enough, very low airflow results in poor air distribution within the conditioned space. Today, a "good" S/T ratio is maintained by conventional HVAC systems by increasing compressor speed to match a minimum blower speed which comes at the cost of increasing the sensible capacity of the system, thereby causing the HVAC system to cycle more frequently and creating condensate re-evaporation issues.

The present disclosure describes systems and methods of controlling relative humidity of an enclosed space. In some embodiments, an HVAC system operating according to one or more methods described herein can increase the ability to dehumidify an enclosed space (i.e., increasing the latent capacity) as compared to conventional HVAC systems operating under similar operating conditions. In some embodiments, improving the latent capacity of an HVAC system is achieved by restricting refrigerant flow to a portion of the available evaporator circuits of an evaporator. This disclosure recognizes that restricting the flow of refrigerant through the evaporator causes a decrease in the suction pressure of a compressor, which in turn results in a colder evaporator and a decreased S/T ratio. As discussed above, a decreased S/T ratio increases the system's latent capacity which also reduces the system's sensible capacity. Operating an HVAC system in this manner may be advantageous, for example, when the HVAC system is operating at a low cooling load (and thus the blower and compressor are operating at their respective minimum speeds).

By operating an HVAC system according to the methods described herein, many of the disadvantages of dehumidification in conventional HVAC systems may be minimized or overcome. For example, the systems and method disclosed herein may permit an increase in runtime of the HVAC system without the degree of overcooling provided in conventional HVAC systems. Relatedly, an HVAC system operating according to the method described herein may cycle less frequently than conventional HVAC systems due to the increased runtime. Accordingly, the systems and method disclosed herein provide various advantages over conventional HVAC systems and are associated with improved methods of dehumidifying an enclosed space, thereby also improving user comfort within the enclosed space.

FIG. 1 illustrates an example of an HVAC system 100. HVAC system 100 includes one or more compressors 110, at least one condenser 120, a first valve 130 (e.g., an expansion valve), an evaporator 140, and a controller 190. In some embodiments, HVAC system 100 is a variable speed compressor system that allows the changing of compressor speed and/or air blower speed. Generally, refrigerant flows through HVAC system 100 undergoing changes to its temperature, pressure, and phase. For example, compressor(s) 110 may receive superheated gaseous refrigerant from evaporator 130 and compress it such that the refrigerant changes phases to become a hot, high-pressure gas. The hot, high-pressure gas refrigerant is discharged from the compressor and received by condenser 120. Fans 125 of condenser 120 operate in a manner which condenses the received hot, high-pressure gas into hot, high-pressure liquid. This hot, high-pressure liquid is expelled from condenser 120 to first expansion valve 130. Upon receiving the hot, high-pressure liquid, first expansion valve 130 operates in a manner which rapidly reduces the pressure of the refrigerant, thereby producing a combination of refrigerant vapor and cold, low-pressure liquid refrigerant. The cold, low-pressure liquid refrigerant is then directed to evaporator 140 to be used to condition air of an enclosed space. For example, air received from a return duct (not illustrated) is blown over circuits 145 of evaporator 140 through which the cold, low-pressure liquid refrigerant is circulated. Due to heat-exchange principles, heat is transferred from the return air to circuits 145, thereby cooling the air and warming the refrigerant in circuits 145. The cooled air is then directed to the enclosed space and the superheated gaseous refrigerant is expelled to the compressor(s) 110.

Although this disclosure describes and depicts HVAC system 100 including particular components, this disclosure recognizes that HVAC system 100 may include (or exclude) one or more components. For example, HVAC system 100 may include an indoor air blower and/or one or more sensors 130. Given the teachings herein, one skilled in the art will understand that HVAC system 100 may include additional components and devices that are not presently illustrated or discussed but are typically included in an HVAC system, such as, a power supply, a distributor, etc. Some illustrated components of HVAC system 100 may be contained within a single enclosure (e.g., a cabinet). In one embodiment, HVAC system 100 is a commercial system, such as a rooftop unit. HVAC system 100 can also be a residential system. In some embodiments, the heating and cooling sources for the HVAC system 100 do not operate until activated for conditioning.

In some embodiments, HVAC system 100 may include a particular tubing configuration for supplying refrigerant to evaporator 140. In some embodiments, the tubing configuration disclosed herein may permit HVAC system 100 to increase its latent capacity. As illustrated in FIG. 1, evaporator 140 includes a plurality of feeding tubes 150 that supply refrigerant to circuits 145 (also referred to herein as "evaporator circuits"). Feeding tubes 150 may extend from one or more distributors 160. Distributors 160 may be configured to distribute a refrigerant flow into one or more feeding tubes 150. As illustrated in FIG. 1, HVAC system 100 includes two distributors (160*a*, 160*b*), each of which are coupled to a plurality of feeding tubes 150. Although this disclosure describes and depicts five (5) feeding tubes 150 coupled to each distributor 160, this disclosure contemplates that any suitable number of feeding tubes 150 may be coupled to each distributor 160. As an example, an HVAC system comprising 8 coils may include four (4) feeding tubes 150 extending from two distributors 160. As another example, an HVAC system comprising 12 coils may include eight (8) feeding tubes 150 extending from a first distributor (e.g., valve 160*a*) and four (4) feeding tubes 150 extending from a second distributor (e.g., valve 160*b*). Generally, one feeding tube 150 supplies refrigerant to one circuit 145.

In some embodiments, HVAC system 100 includes one or more valves in addition to valve 130. For example, as illustrated in FIG. 1, HVAC system 100 includes second valve 180. In some embodiments, second valve 180 is a solenoid valve. As will be described in more detail below, second valve 180 may be configured to receive instructions from a controller (e.g., controller 190 of FIG. 1) and, in some cases, the instructions are to open and or close second valve 180.

As illustrated in FIG. 1, cold, low-pressure liquid refrigerant is discharged from valve 130 and is directed along two paths: (1) pathway A (indicated by "A" in FIG. 1); and (2) pathway B (indicated by "B" in FIG. 1). Refrigerant flowing along Pathway A passes directly to distributor 160*a* where it is then distributed to evaporator circuits 145 within evaporator 140. Comparatively, refrigerant flowing along Pathway B passes first through second valve 180 before reaching distributor 160*b*. Once reaching distributor 160*b*, refrigerant flowing along Pathway B is then distributed to evaporator circuits 145 by distributor 160*b*. As recognized herein, second valve 180 is operable to open and close to permit or restrict, respectively, the flow of refrigerant.

In some embodiments (such as the embodiment illustrated in FIG. 1), HVAC system 100 includes at least one controller 190. Controller 190 may include one or more processors, such as microprocessors, configured to direct the operation of HVAC system 100. Additionally, HVAC controller 190 may include an interface and a memory coupled thereto. The interface may include multiple ports for transmitting and receiving data from at least other components or devices of the HVAC system 100, such as compressors 110, an indoor air blower (not illustrated) and/or sensors (not illustrated). The interface may also receive input from an operator of HVAC system 100. The memory section may be a conventional memory that is constructed to store data and computer programs, including data and programs to provide functionality as disclosed herein. In some embodiments, controller 190 is operable to start a timer and detect when such timer has expired. As will be described in more detail below, controller 190 may begin a timer upon closing second valve 180 and open second valve 180 upon determining that one or more conditions are met.

HVAC controller 190 may be communicably coupled to one or more components of HVAC system 100. In some embodiments, the connections therebetween are through a wired-connection. A conventional cable and contacts may be used to couple the HVAC controller 190 to the various components of HVAC system 100 via the controller interface. In other embodiments, a wireless connection may also be employed to provide at least some of the connections. HVAC controller 190 may also be communicably coupled to one or more cloud platforms configured to store and/or execute instructions corresponding to one or more functions disclosed herein.

As described above, HVAC controller 190 may be operable to instruct second valve 180 to open or close to permit or restrict, respectively, refrigerant from flowing along Path B to evaporator 140. In some embodiments, controller 190 instructs second valve 180 to close upon determining that a value associated with HVAC system 100 exceeds a cooling threshold. In other embodiments, controller 190 instructs second valve 180 to close upon determining that value associated with HVAC system 100 exceeds a dehumidification threshold. In some embodiments, the value to which the cooling and/or dehumidification threshold is compared is calculated based on a speed of an air blower of HVAC system 100 divided by the actual total capacity of HVAC system 100 (in tons). Closing second valve 180 increases the velocity of refrigerant flowing through evaporator 140 (due to refrigerant only traveling through a portion of the evaporator circuits 145), which in turn causes a decrease in the suction pressure of HVAC system 100. This may be advantageous, for example, when additional dehumidification is desired but additional cooling is not desired. In such case, controller 190 may operate the air blower (not illustrated) and compressors 110 at low speeds (e.g., operate the air blower at 900 cubic feet per minute ("CFM") and compressors 110 at 22 hertz ("Hz")) and maintain a S/T ratio conducive for dehumidification. Stated differently, closing second valve 180 may increase the latent capacity of HVAC system 100, permitting more dehumidification of an enclosed space as compared to conventional HVAC system that cannot increase latent capacity by reducing the flow of refrigerant through evaporator 140.

Controller 190 may instruct second valve 180 to open under specific circumstances. For example, controller 190 may instruct second valve 180 to open upon determining that the air blower of HVAC system 100 is operating at speed that exceeds a speed threshold (e.g., 1.25×minimum air bower speed). This may occur, for example, when controller 190 determines that a cooling setpoint is not being reached under the current operating conditions. As another example, controller 190 may instruct second valve 180 to open upon determining that a timer has expired. As yet another example, controller 190 may instruct second valve 180 to open upon determining that the speed of the air blower exceeds a speed threshold and that a timer has expired.

As described above, processor of controller 190 may be configured to perform the functionality described herein by executing one or more algorithms (that may be stored to the memory of controller 190). As an example, the following algorithm may be implemented by the processor of controller 190: (1) determine that an air blower of HVAC system 100 is operating at a minimum speed; (2) determine a first value associated with HVAC system 100, the first value calculated based on a speed of an air blower of HVAC system 100 and a total capacity of HVAC system 100; (3) determine that HVAC system 100 is operating in a cooling mode; (4) determine that the first value exceeds a cooling threshold (e.g., 400 CFM/active ton); (5) instruct second valve 180 to close such that refrigerant is not permitted to flow to a first portion of evaporator circuits 145; (6) set a timer for a predetermined amount of time when second valve 180 closes; (7) determine that the air blower of HVAC system 100 exceeds a speed threshold (e.g., 1125 CFM) and that the predetermined amount of time has elapsed; and (7) open second valve 180 such that refrigerant is permitted to flow to the first portion of evaporator circuits 145. As another example, the following algorithm may be implemented by the processor of controller 190: (1) determine that an air blower of HVAC system 100 is operating at a minimum speed; (2) determine a first value associated with HVAC system 100, the first value calculated based on a speed of an air blower of HVAC system 100 and a total capacity of HVAC system 100; (3) determine that HVAC system 100 is operating in a dehumidification mode; (4) determine that the first value of HVAC system 100 exceeds a dehumidification threshold (e.g., 300 CFM/active ton); (5) instruct second valve 180 to close such that refrigerant is not permitted to flow to a first portion of evaporator circuits 145; (6) set a timer for a predetermined amount of time when second valve 180 closes; (7) determine that the air blower of HVAC system 100 exceeds a speed threshold (e.g., 1125 CFM) and that the predetermined amount of time has elapsed; and (7) open second valve 180 such that refrigerant is permitted to flow to the first portion of evaporator circuits 145.

Figure 2B:
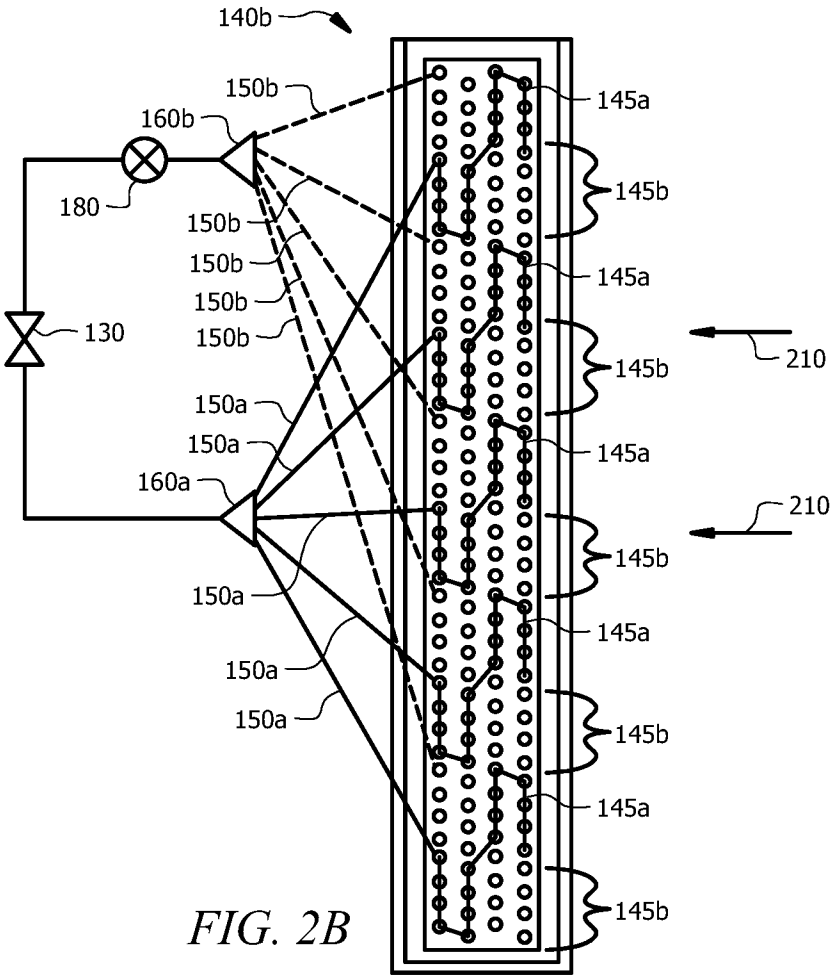
FIG. 2B illustrates another evaporator configuration that permits the HVAC system of FIG. 1 to increase its capacity to remove latent heat from an enclosed space, according to particular embodiments.
Figure 2A:
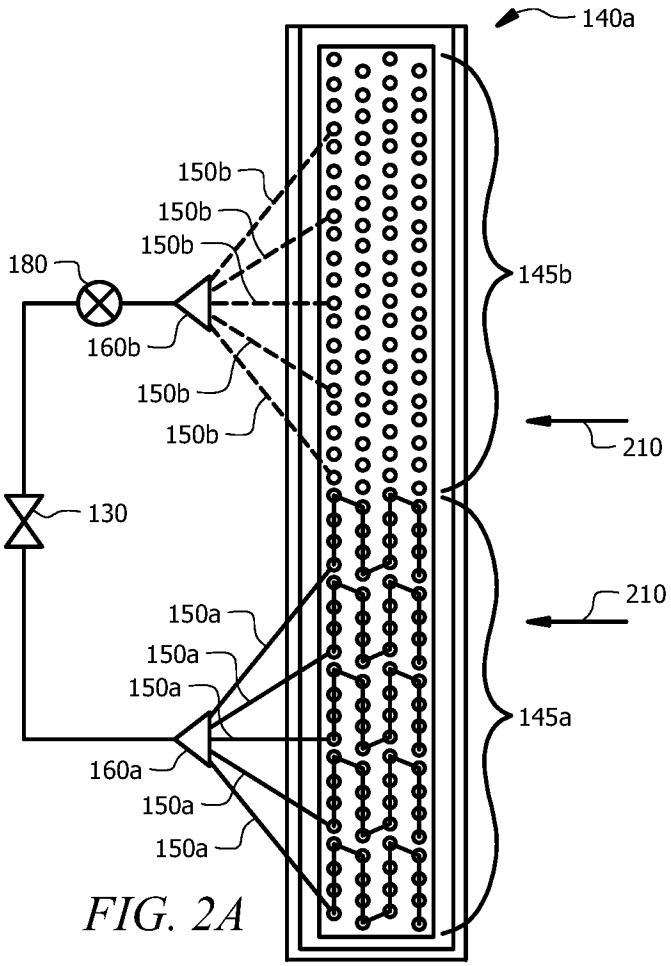
FIG. 2A illustrates an evaporator configuration that permits the HVAC system of FIG. 1 to increase its capacity to remove latent heat from an enclosed space, according to particular embodiments.
Figure 3:
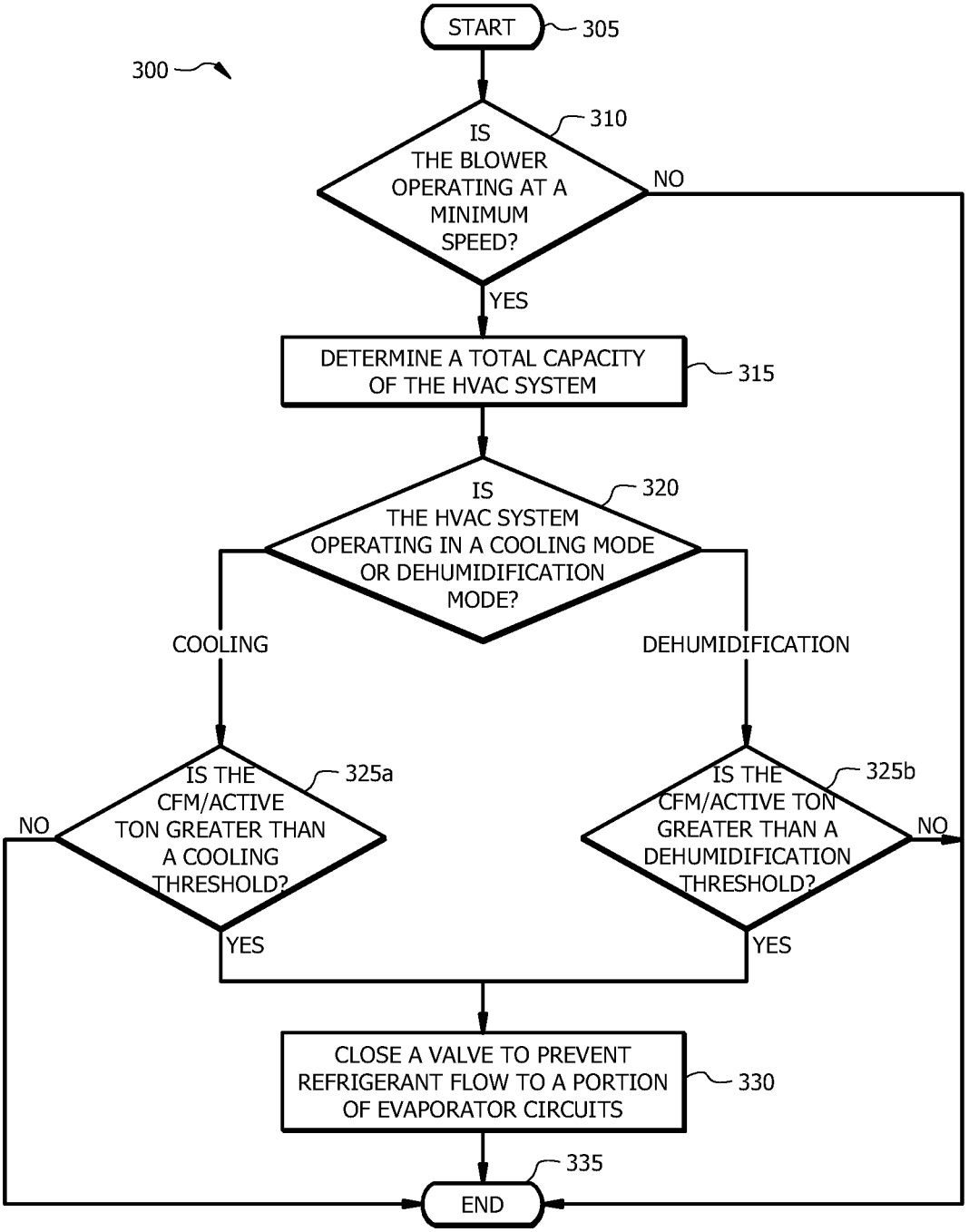
FIG. 3 depicts a flow chart illustrating a method of operation for at least one controller associated with the HVAC system of FIG. 1, according to one embodiment.
Figure 4:
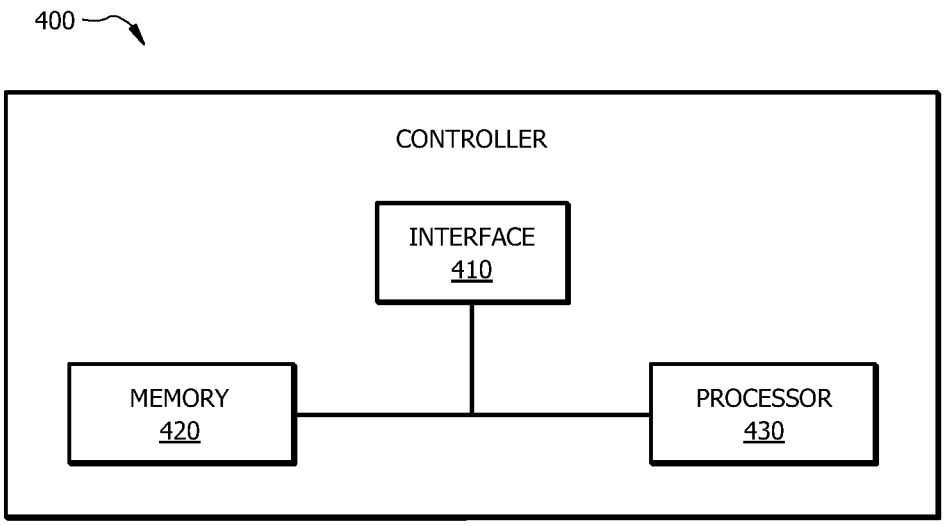
FIG. 4 illustrates an example of a controller for an HVAC system that is operable to perform the method illustrated in FIG. 3, according to certain embodiments.

Generally, FIG. 1 illustrates an example of an HVAC system operable to increase its capacity to remove latent heat from an enclosed space by employing an improved evaporator configuration. FIG. 2 illustrates two embodiments of the improved evaporator configuration of FIG. 1 (see FIG. 2A and FIG. 2B) and FIG. 3 illustrates a method of increasing an HVAC system's capacity to remove latent heat in an HVAC system employing the improved evaporator configuration of FIG. 2. Finally, FIG. 4 depicts an example of a controller operable to perform the method illustrated of FIG. 3.

As described above, FIG. 2 depicts two separate embodiments of the improved evaporator configuration illustrated in FIG. 1. Generally, each embodiment (FIG. 2A and FIG. 2B) illustrate an evaporator configuration that includes first and second paths "A" and "B", second valve 180, first and second distributors 160*a*, 160*b*, one or more feeding tubes 150, and one or more evaporator circuits 145 within evaporator 140. As discussed above, refrigerant may flow to evaporator circuits 145 via Path "A" and/or "B" depending on whether second valve 180 is open or closed. The embodiments of FIG. 2 differ in their evaporator circuitry design but are similar in that both embodiments divide evaporator circuits 145 into two portions, wherein one portion of evaporator circuits 145 receives refrigerant via Path "A" and the other portion of evaporator circuits 145 receives refrigerant via Path "B." Specifically, as illustrated in FIGS. 2A and 2B, evaporator comprises ten (10) evaporator circuits 145, five (5) of which receive refrigerant via Path "A" (i.e., evaporator circuits 145*a*) and five (5) of which receive refrigerant via Path "B" (i.e., evaporator circuits 145*b*).

Turning now to FIG. 2A, FIG. 2A illustrates a "Face Split" circuit design wherein feeding tubes 150*a* provide refrigerant to a first portion of evaporator circuits 145*a* that are adjacent to one another and feeding tubes 150*b* provide refrigerant to a second portion of evaporator circuits 145*b* that are also adjacent to one another. Specifically, FIG. 2A illustrates an evaporator configuration wherein the five (5) evaporator circuits 145 receiving refrigerant from Path "A" (i.e., 145*a*) are adjacent one another and the five (5) evaporator circuits receiving refrigerant from Path "B" are adjacent one another (i.e. 145*b*). In some embodiments, evaporator circuits 145*a* are positioned towards a top portion of evaporator 140*a* and evaporator circuits 145*b* are positioned towards a bottom portion of evaporator 140*b*. In other embodiments, evaporator circuits 145*a* are positioned towards a bottom portion of evaporator 140*a* and evaporator circuits 145*b* are positioned towards a bottom portion of evaporator 140*b*. This disclosure recognizes certain advantages of configuring evaporator 140 such that active circuits 145 (e.g., active circuits 145*a*) are positioned towards a bottom portion of evaporator 140. For example, the "Face Split design may have less re-condensation issues when active circuits are positioned on the bottom portion of evaporator 140 than on the top portion. The "Face Split" design may be associated with one or more benefits. For example, closing second valve 180 reduces the suction pressure of compressors 110 and, relatedly, the S/T ratio while also increasing the latent capacity of HVAC system 100.

In comparison, FIG. 2B illustrates an "Intertwined" circuit design wherein feeding tubes 150*a* provide refrigerant to a first portion of evaporator circuits 145*a* which are interspersed between and/or among evaporator circuits 145*b* (which receive refrigerant via Path "B"). As shown in FIG. 2B, each evaporator circuit 145*b* is positioned adjacent at least one evaporator circuit 145*a* (which receive refrigerant via Path "A"). The "Intertwined" design may be associated with one or more benefits. For example, closing second valve 180 may increase the latent capacity of HVAC system 100 although the increase may not be as large as compared to the "Face Split" design. This is because the decrease in suction pressure is limited to increased refrigerant flow through evaporator circuits 145*a* and not the reduction of air over the active evaporator coils. Although the "Intertwined" design may not be as effective as the "Face Split" design at increasing the latent capacity of HVAC system 100, the "Intertwined" design is not associated with re-evaporation issues that may present when implementing the "Face Split" design. Additionally, due to the configuration of active versus inactive coils in the "Intertwined" design, an evaporator 140 having a "Intertwined" design may experience less recondensation issues than the "Face Split" design.

Although this disclosure describes and depicts 50% of evaporator circuits 145 receiving refrigerant via Path "A" or Path "B", this disclosure recognizes that any suitable and/or desired percentage of evaporator circuits 145 may receive refrigerant via Path "A" or Path "B." For example, 80% of evaporator circuits 145 may be configured to receive refrigerant via Path "A" and 20% of evaporator circuits 145 may be configured to receive refrigerant via Path "B." As another example, 30% of evaporator circuits 145 may be configured to receive refrigerant via Path "A" and 70% of evaporator circuits 145 may be configured to receive refrigerant via Path "B."

Furthermore, this disclosure recognizes that HVAC system 100 may include any suitable number of distributors 160 and valves to improve the latent capacity of HVAC system 100. For example, HVAC system 100 may include three paths (e.g., Path "A," Path "B," and Path "C" (not illustrated)) and a solenoid valve (e.g., valve 180) may be placed upstream of Path "B" and Path "C" such that closing such valve prevents refrigerant from flowing along Path "B" or Path "C."

FIG. 3 illustrates a method of operation for HVAC system 100. In some embodiments, the method 300 may be implemented by a controller of HVAC system (e.g., controller 190 of FIG. 1). In some embodiments, method 300 is stored on a computer readable medium, such as a memory of controller 190 (e.g., memory 420 of FIG. 4), as a series of operating instructions that direct the operation of a processor (e.g., processor 430 of FIG. 4). In other embodiments, method 300 is implement using components of cloud computing platform. In some embodiments, the method 300 begins in step 305 and continues to step 310.

At step 310, a controller of HVAC system (e.g., controller 190 of HVAC system 100) determines whether an air blower of the HVAC system is operating at a minimum speed. As described above, HVAC system 100 may be a variable speed compression system in some embodiments and, in such embodiments, the speed of the air blower may be variable. As an example, the speed of an air blower may vary from 900 CFM (minimum) to 1800 CFM (maximum). In some embodiments, if it is determined at step 310 that the air blower is operating at a minimum speed (e.g., 900 CFM), the method 300 may proceed to a step 315. If, however, it is determined at step 310 that the air blower is not operating at a minimum speed (e.g., exceeds 900 CFM), the method 300 may proceed to an end step 335.

At step 315, controller 190 determines a first value associated with HVAC system 100. As described above, the first value may be calculated as the speed of an air blower of HVAC system 100 divided by the actual total capacity (in tons) of HVAC system 100. In some embodiments, the method proceeds to a step 320 after determining the first value of HVAC system 100.

At step 320, controller 190 determines whether HVAC system 100 is operating in a cooling mode or a dehumidification mode. If at step 320, controller 190 determines that HVAC system 100 is operating in a cooling mode, the method 300 proceeds to step a 325*a*. At step 325*a*, controller 190 determines whether the first value determined at step 315 exceeds a cooling threshold. As an example, the cooling threshold may be set to 400 CFM/active ton. If at step 325*a* controller 190 determines that the first value determined at step 315 exceeds a cooling threshold, the method 300 proceeds to a step 330. In contrast, if controller 190 determines at step 325*a* that the first value determined at step 315 does not exceed a cooling threshold, the method 300 proceeds to end step 335.

If, however, controller 190 determines at step 320 that HVAC system 100 is operating in a dehumidification mode, the method 300 proceeds to a step 325*b*. At step 325*b*, controller 190 determines whether the first value determined at step 315 exceeds a dehumidification threshold. As an example, the cooling threshold may be set to 300 CFM/active ton. If at step 325*b* controller 190 determines that the first value determined at step 315 exceeds a dehumidification threshold, the method 300 proceeds to a step 330. In contrast, if controller 190 determines at step 325*b* that the first value determined at step 315 does not exceed a dehumidification threshold, the method 300 proceeds to end step 335.

At step 330, controller 190 instructs a valve (e.g., second valve 180) of HVAC system 100 to close. In some embodiments, the valve closes in response to receiving the instructions from controller 190. Closing the valve may prevent refrigerant from flowing to a portion of evaporator circuits of evaporator 140. For example, in response to second valve 180 receiving a closing instruction from controller 190, second valve 180 closes preventing refrigerant from flowing along Path "B" to evaporator 140. As described above, closing second valve 180 may result in an increase in the latent capacity of HVAC system 100. In some embodiments, the method 300 proceeds to end step 335 after instructing a valve to close.

In some embodiments, method 300 excludes one or more of the above identified steps. In other embodiments, method 300 includes one or more additional steps. For example, method 300 may include a step wherein controller 190 starts a timer for a predetermined amount of time (e.g., 10 minutes) in response to second valve 180 closing. Thereafter, controller 190 may determine that the air blower is no longer operating at a minimum speed (and, in some embodiments, is operating at a speed exceeding a speed threshold), and further determine that the predetermined amount of time has expired. In response to making these determinations, controller 190 may instruct second valve 180 to open such that refrigerant may flow to the portion of evaporator circuits 145 that were previously blocked (at a result of step 330). The method 300 may repeat as many times as necessary or desired in order to achieve user comfort within an enclosed space.

Finally, FIG. 4 illustrates an example controller 400 of HVAC system 100, according to certain embodiments of the present disclosure. In some embodiments, controller 400 may be an example of controller 190 described herein in relation to FIGS. 1-3. Controller 400 may comprise one or more interfaces 410, memory 420, and one or more processors 430. Interface 410 receives input (e.g., sensor data or system data), sends output (e.g., data, instructions), processes the input and/or output, and/or performs other suitable operation. Interface 410 may comprise hardware and/or software. As an example, interface 410 receives information (e.g., temperature, operation, speed, pressure information) about one or more components of systems 100 (e.g., via sensors).

Memory (or memory unit) 420 stores information. As an example, memory 420 may store method 300. Memory 420 may comprise one or more non-transitory, tangible, computer-readable, and/or computer-executable storage media. Examples of memory 420 include computer memory (for example, Random Access Memory (RAM) or Read Only Memory (ROM)), mass storage media (for example, a hard disk), removable storage media (for example, a Compact Disk (CD) or a Digital Video Disk (DVD)), database and/or network storage (e.g., a server and/or cloud storage and processing), and/or other computer-readable medium.

Processor 430 may include any suitable combination of hardware and software implemented in one or more modules to execute instructions and manipulate data to perform some or all of the described functions of controller 400. In some embodiments, processor 430 may include, for example, one or more computers, one or more central processing units (CPUs), one or more microprocessors, one or more applications, one or more application specific integrated circuits (ASICs), one or more field programmable gate arrays (FPGAs), and/or other logic.

Modifications, additions, or omissions may be made to the systems, apparatuses, and methods described herein without departing from the scope of the disclosure. The components of the systems and apparatuses may be integrated or separated. Moreover, the operations of the systems and apparatuses may be performed by more, fewer, or other components. For example, refrigeration system 100 may include any suitable number of compressors, condensers, condenser fans, evaporators, valves, sensors, controllers, and so on, as performance demands dictate. One skilled in the art will also understand that refrigeration system 100 can include other components that are not illustrated but are typically included with refrigeration systems. Additionally, operations of the systems and apparatuses may be performed using any suitable logic comprising software, hardware, and/or other logic. As used in this document, "each" refers to each member of a set or each member of a subset of a set.

Modifications, additions, or omissions may be made to the methods described herein without departing from the scope of the disclosure. The methods may include more, fewer, or other steps. Additionally, steps may be performed in any suitable order.

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure.

The invention claimed is:

1. A heating, ventilation, and air conditioning ("HVAC") system operable to condition an enclosed space, the HVAC system comprising:

an evaporator operable to cool and/or dehumidify air circulating through the HVAC system, the evaporator comprising one or more evaporator circuits, the one or more evaporator circuits comprising:

a first portion adapted to receive the refrigerant from a first refrigerant path; and a second portion adapted to receive the refrigerant from a second refrigerant path;

a valve operable to permit or restrict the flow of the refrigerant to the second portion of the one or more evaporator circuits;

an air blower operable to push at least a minimum volume of air into the enclosed space; and a controller comprising processing circuitry and a computer readable storage medium comprising instructions that, when executed by the processing circuitry, cause the controller to:

determine a first value associated with the HVAC system, wherein the first value is calculated based on a speed of the air blower and a total capacity of the HVAC system; and close the valve such that the refrigerant cannot flow to the second portion of the evaporator circuits upon determining that:

the first value exceeds a cooling threshold; or the first value exceeds a dehumidification threshold.

2. The system of claim 1, wherein:

the controller determines the first value and whether to close the valve in response to determining that the air blower is operating at a minimum speed.

3. The system of claim 1, wherein the controller comprises further instructions that, when executed by the processing circuitry, cause the controller to:

determine whether the HVAC system is operating in a cooling mode; and determine to compare the first value to the cooling threshold when the HVAC system is operating in the cooling mode.

4. The system of claim 1, wherein the controller comprises further instructions that, when executed by the processing circuitry, cause the controller to:

determine whether the HVAC system is operating in a dehumidification mode; and determine to compare the first value to the dehumidification threshold when the HVAC system is operating in the dehumidification mode.

5. The system of claim 1, wherein the controller comprises further instructions that, when executed by the processing circuitry, cause the controller to:

start a timer for a predetermined amount of time; and in response to determining that the predetermined amount of time has expired and that the air blower is pushing an amount of air exceeding a volume threshold into the enclosed space, open the valve such that the refrigerant can flow to the second portion of the evaporator circuits.

6. The system of claim 1, wherein:

the first portion of evaporator circuits are adjacent each other and the second portion of evaporator circuits are adjacent each other.

7. The system of claim 1, wherein:

the first portion of evaporator circuits comprises two or more first evaporator circuits and the second portion of evaporator circuits comprises two or more second evaporator circuits; and at least one of the two or more first evaporator circuits is interspersed between at least two of the second evaporator circuits.

8. The HVAC system of claim 1, wherein the HVAC system is a variable speed compressor system.

9. The HVAC system of claim 1, wherein the latent capacity of the HVAC system increases by closing the valve.

10. The HVAC system of claim 1, wherein the valve is a solenoid valve.

11. A method, the method comprising:

providing control for a heating, ventilation, and air conditioning ("HVAC") system that comprises a first portion of each of a plurality of evaporator circuits adapted to receive refrigerant from a first refrigerant path and a second portion of each of the plurality of evaporator circuits adapted to receive the refrigerant from a second refrigerant path, wherein providing the control comprises:

determining, by a controller of the HVAC system, a first value associated with the HVAC system, wherein:

the first value is calculated based on a speed of an air blower of the HVAC system and a total capacity of the HVAC system; and the air blower is operable to push a minimum volume of air in to an enclosed space; and upon determining that first value exceeds a cooling threshold or that the first value exceeds a dehumidification threshold, instructing, by the controller, a valve of the HVAC system to close such that the refrigerant cannot flow to the first portion of each of the plurality of evaporator circuits of the HVAC system.

12. The method of claim 11, further comprising:

determining, by the controller, the first value and whether to close the valve in response to determining that the air blower is operating at a minimum speed.

13. The method of claim 11, wherein the method further comprises:

determining, by the controller, whether the HVAC system is operating in a cooling mode; and determining, by the controller, to compare the first value to the cooling threshold when the HVAC system is operating in the cooling mode.

14. The method of claim 11, wherein the method further comprises:

determining, by the controller, whether the HVAC system is operating in a dehumidification mode; and determining, by the controller, to compare the first value to the dehumidification threshold when the HVAC system is operating in the dehumidification mode.

15. The method of claim 11, the method further comprising:

starting, by the controller, a timer for a predetermined amount of time; and in response to determining that the predetermined amount of time has expired and that the air blower is pushing an amount of air exceeding a volume threshold into the enclosed space, instructing, by the controller, the valve to open such that the refrigerant can flow to the second portion of each of the plurality of the evaporator circuits.

16. The method of claim 11, wherein:

the first portion of each of the plurality of evaporator circuits are adjacent to each other and the second portion of each of the plurality of evaporator circuits are adjacent to each other.

17. The method of claim 11, wherein:

the first portion of each of the plurality of evaporator circuits comprises two or more first evaporator circuits and the second portion of each of the plurality of evaporator circuits comprises two or more second evaporator circuits; and at least one of the two or more first evaporator circuits is interspersed between at least two of the second evaporator circuits.

18. A controller comprising processing circuitry and a computer readable storage medium comprising instructions that, when executed by the processing circuitry, cause the controller to:

provide control for a heating, ventilation, and air conditioning ("HVAC") system that comprises a first portion of each of a plurality of evaporator circuits adapted to receive refrigerant from a first refrigerant path and a second portion of each of the plurality of evaporator circuits adapted to receive the refrigerant from a second refrigerant path, wherein to provide the control, the instructions, when executed by the processing circuitry, further cause the controller to:

determine a first value associated with the HVAC system, wherein:

the first value is calculated based on a speed of an air blower of the HVAC system and a total capacity of the HVAC system; and the air blower is operable to push a minimum volume of air in to the enclosed space;

upon determining that the first value exceeds a cooling threshold or that the first value exceeds a dehumidification threshold, instruct a valve of the HVAC system to close such that the refrigerant cannot flow to the first portion of each of the plurality of evaporator circuits of the HVAC system.

19. The controller of claim 18, wherein the first portion of each of the plurality of evaporator circuits are adjacent each other and the second portion of each of the plurality of evaporator circuits are adjacent each other.

20. The controller of claim 18, wherein:

the first portion of each of the plurality of evaporator circuits comprises two or more first evaporator circuits and the second portion of each of the plurality of evaporator circuits comprises two or more second evaporator circuits;

and at least one of the two or more first evaporator circuits is interspersed between at least two of the second evaporator circuits.

* * * * *